US009239136B1

(12) United States Patent
Petersen et al.

(10) Patent No.: US 9,239,136 B1
(45) Date of Patent: Jan. 19, 2016

(54) CONNECTOR FOR LIGHT-EMITTING DIODE STRIP

(71) Applicant: Elemental LED, Inc., Emeryville, CA (US)

(72) Inventors: Russell Petersen, Livermore, CA (US); Mark Kelley, Oakland, CA (US); Andreas Dankelmann, San Francisco, CA (US)

(73) Assignee: Elemental LED, Inc., Emeryville, CA (US)

( * ) Notice: Subject to any disclaimer, the term of this patent is extended or adjusted under 35 U.S.C. 154(b) by 219 days.

(21) Appl. No.: 13/967,017

(22) Filed: Aug. 14, 2013

(51) Int. Cl.
*A41F 1/00* (2006.01)
*F21K 99/00* (2010.01)
*H01R 13/62* (2006.01)

(52) U.S. Cl.
CPC ... *F21K 9/30* (2013.01); *F21K 9/90* (2013.01); *H01R 13/62* (2013.01)

(58) Field of Classification Search
CPC ..... F21S 4/001; F21S 4/003; F21S 4/005; F21S 4/006; F21S 4/007; H05K 1/14; H05K 1/118; H05K 1/145; H05K 1/0274; G02B 6/426; H01R 13/501; H01R 13/506; H01R 13/508; H01R 13/627
USPC ..... 362/581, 217.13, 217.17
See application file for complete search history.

(56) References Cited

U.S. PATENT DOCUMENTS

| | | | | |
|---|---|---|---|---|
| 5,848,837 | A | 12/1998 | Gustafson | |
| 6,802,748 | B2 | 10/2004 | Wertz et al. | |
| 8,297,788 | B2 * | 10/2012 | Bishop | 362/249.02 |
| 8,454,193 | B2 * | 6/2013 | Simon et al. | 362/217.17 |
| 2005/0215108 | A1 * | 9/2005 | Chen | 439/409 |
| 2005/0260874 | A1 * | 11/2005 | Murakami et al. | 439/142 |
| 2009/0064571 | A1 | 3/2009 | Fakhari | |
| 2010/0008090 | A1 * | 1/2010 | Li et al. | 362/249.03 |
| 2015/0117005 | A1 * | 4/2015 | Zanotto et al. | 362/249.1 |

FOREIGN PATENT DOCUMENTS

| | | | |
|---|---|---|---|
| EP | 2078895 | B1 | 12/2012 |
| WO | 2013010445 | A1 | 1/2013 |

* cited by examiner

*Primary Examiner* — Andrew Coughlin
(74) *Attorney, Agent, or Firm* — PatentBest; Andrew McAleavey

(57) ABSTRACT

An LED connector half (500) mates with a wire connector half (300) to connect a light strip (100) comprising LEDs (115) to a pair of wires. The LED half includes a hinged top (700) with an opening (705) to admit an end LED on the strip when the top is closed, securing the strip to the connector half without blocking the LED. The wire half secures a pair of wires (315) to terminals (305) in a housing (310). The wire half is inserted into the LED half, connecting the Electrodes and terminals. The halves are held together by a tongue (320) and socket (800). In another aspect, a connector (1100) joins two light strips by capturing the LEDs at the ends of the strips in openings (1110) and clamping conductive electrodes (1140) against the strips by closing a lid (1105) against the body, without obscuring LED light output.

17 Claims, 3 Drawing Sheets

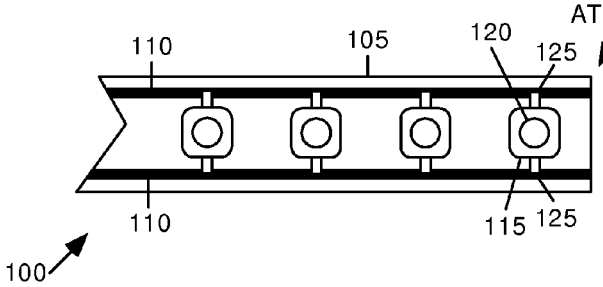
Fig. 1--Prior Art
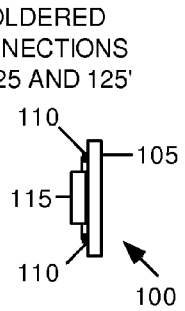
Fig. 2--Prior Art
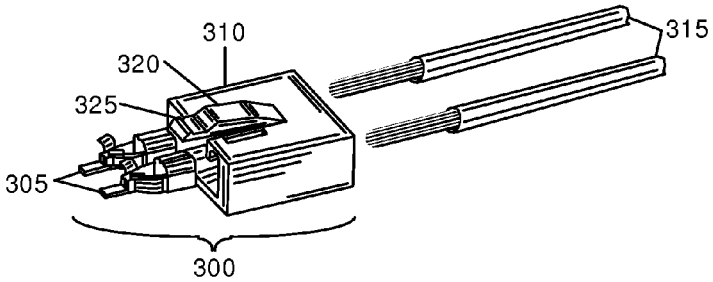
Fig. 3
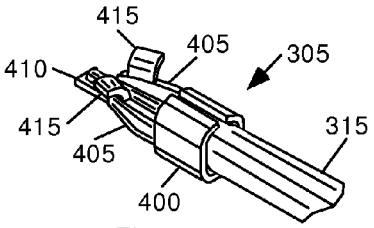
Fig. 4
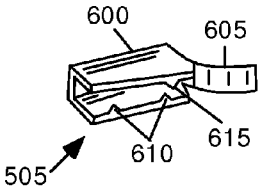
Fig. 6
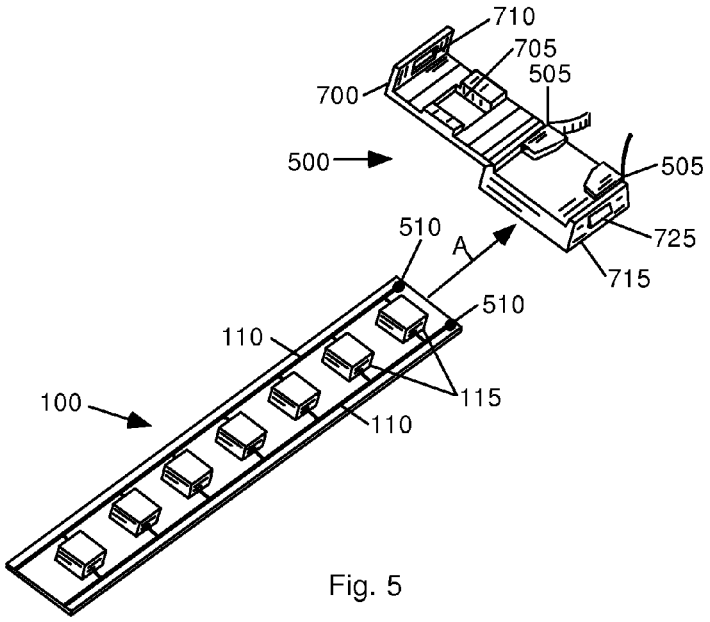
Fig. 5

CONNECTOR FOR LIGHT-EMITTING DIODE STRIP

BACKGROUND

Prior Art

Light-emitting diode (LED) lighting systems are in common use today. They offer improved electrical efficiency when compared with incandescent and fluorescent lighting. Individual LED lights are relatively small, ranging in size from a fraction of one millimeter for a single LED to an array of LEDs that is a square centimeter or more, comprising an array of smaller devices. Such lights incorporate lenses, reflectors, phosphors, and diffusers that influence the size, shape, and appearance of light output.

Prior-art LEDs are often sold in groups formed into a strip configuration that can have any length. These are often seen as flexible strands of lights used in holiday decorations, advertising, and emergency lighting. One such flexible strip configuration employs wire busses to which LEDs and a power source are connected.

Another prior-art strip configuration comprises conductors on one or more printed circuit boards (PCBs) to which are attached a plurality of LEDs, often by a well-known surface mount method.

In order to cause the LEDS on the strip to illuminate, power must be supplied to them from a power supply which usually energizes pair of wires with a direct-current potential. These wires must be connected to the conductors on the PCB to supply operating current for the LEDs. Various connectors have been used and proposed to connect such wires to the PCB. The following is a list of some possibly relevant prior art that shows connectors for connecting wires to prior-art LED strip lighting systems. Following this list I provide a discussion of these references.

| Pat. or Pub. No. | Kind Code | Issue or Pub. Date | Patentee or Applicant |
|---|---|---|---|
| U.S. 5,848,837 | B1 | Dec. 15, 1998 | Gustafson |
| U.S. 6,802,748 | B2 | Oct. 12, 2004 | Wertz et al. |
| U.S. 2009/0064571 | A1 | Mar. 12, 2009 | Fakhari |
| EP 2078895 | B1 | Dec. 12, 2012 | Flashaar-Blooedorn |
| WO 2013/010445 | A1 | Jan. 24, 2013 | Yong Zhang |

Gustafson shows an integrally formed linear light strip with LEDs. The light strip is encapsulated between upper and lower thermoplastic extrusions. First and second bus elements are spaced apart and parallel to one-another on a printed circuit strip and LEDs are connected between the first and second bus elements. Connectors at the ends of his light strips connect to either a power source or to another light strip. The connectors are "metal connector pins heat-staked into the thermoplastic to contact the strip bus elements for interconnection of the light strips or for connection of light strips to the power source . . . " Gustafson also suggests using "conventional wiring means" or an electrical connector such as taught in U.S. Pat. No. 5,391,088 (to Tomchak, et al.) and used in lighting strips or surface wiring. The connector taught in this patent employs male pins that are crimped onto the ends of wires, are encased in an electrically conductive gel, and housed in a first rigid housing that mates with a second rigid housing with flat electrical conductors. "Conventional wiring means" implies the soldering or clamping together of conductors. The connectors taught in U.S. Pat. No. 5,391,088 must be urged together using at least one screw. None of these wiring means provides a quick-connect and quick-release feature simply joining the ends of conductors and the printed circuit portion of his light strip.

Wertz et al. show a three-point spring contact design used to connect varied electrical components to circuit boards. An elongated body has a long axis extending between a solderable portion at a first end and three spring contacts at a second end. The three spring contacts are urged against a single wire with the axis of the wire oriented perpendicularly to the long axis of the body. While this connector is useful for its intended purpose, its required orientation and method of connection to a wire renders it unsuitable as low-profile, flat connector to a PCB.

Fakhari shows an electrical conductor strip containing embedded wires. The strip is an elongated, flat ribbon. It is used as a lawn edging and is normally installed underground so that the top surface, i.e. the edge of the ribbon, faces upward. Lights are attached to the embedded wires using various means. Various means including wire nuts are used to join strips by joining their wires serially and to connect light sources such as LEDs to these wires. While this strip is useful it is also very bulky by nature, due to its outdoor placement at the lawn edge.

Flashaar-Blooedorn shows an LED light strip with a bus having a plurality of wires with self-healing insulation. The wires carry power for the LEDs and optionally also carry data for controlling the operation of the light strip. A plurality of pins connected to the light strip pierce the insulation on the wires and deliver power to the LEDs. A snap-on bridge connector joins LED strips. While this strip is useful, it is also bulky by nature since it contains a layer of wires underneath the LEDs.

Yong shows a piercing connector for a flexible LED light strip. Wires for supplying power to the LED strip are each terminated a piercing point. The piercing points are held in a fixture with a lid. The light strip is positioned in the fixture and the lid is closed, causing the piercing points to pierce conductors on the strip, thereby securing the strip to the connector.

SUMMARY

We have discovered a method and apparatus that employs a plurality of electrically conductive pressure contacts to deliver power to a plurality of respective busses on a PCB strip having at least one LED attached. An openable and removable connector captures one or more LEDs when it is closed and attached to the PCB, thereby using the LED that was previously anchored to the PCB as an anchor. In a first aspect of a first embodiment, our connector comprises two parts: a first part provides a terminus for wires of different wire gauges that deliver power to the strip, and a second part that is anchored to at least one LED on the PCB removably captures the first part, thereby securely attaching the wires to the PCB strip without compromising or obscuring light output of the LED closest to the end of the PCB strip. In a second aspect, our connector provides electrically conductive pressure contacts that electrically join two PCB strips at their respective ends while securely anchoring itself to at least one LED located near the end of each strip without compromising or obscuring the light output of the LED's closest to the end of the strip.

DRAWING FIGURES

FIGS. 1 and 2 show a prior-art LED light strip.

FIG. 3 is a perspective view of a power or wire connector portion that is ready for assembly.

FIG. 4 is a detail of a component of the connector of FIG. 3.

FIG. 5 is a perspective view of a LED connector portion assembly prior to assembly.

FIG. 6 is a perspective view of a component of the assembly in FIG. 5.

DRAWING REFERENCE NUMERALS

Figure 7:
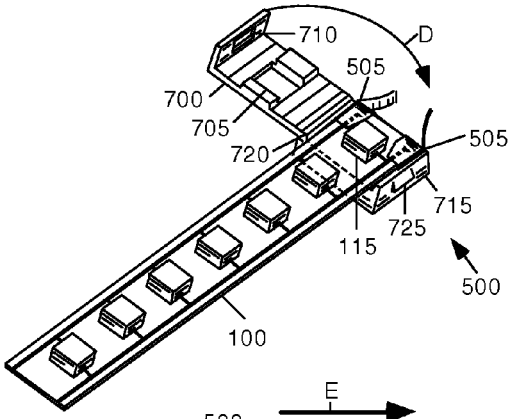
FIG. 7 is a perspective view of the components in FIG. 5, ready for assembly.

100 LED strip 105 Board
110 Conductor 115 LED
120 Portion 125 Connection
300 Wire Connector Portion 305 Terminal
310 Housing 315 Wire
320 Tongue 325 Tip
400 Collar 405 Arm
410 Contact tongue 415 Wing
500 Anchor Connector Portion 505 Electrode
510 Solder 600 Body
605 Arm 610 Teeth
705 Opening 710 Opening
715 Body 720 Hinge
725 Projection 800 Socket
815 Slot 1100 Strip to Strip Connector
1105 Lid 1110 Opening
1112 Projection 1115 Body
1120 Hinge 1125 Channel
1130 Member 1135 Teeth
1140 Electrode 1145 Teeth

DESCRIPTION

Prior Art LEDs and Light Strips—FIGS. 1 and 2

FIGS. 1 and 2 show a plan and end views, respectively, of one end of a prior-art PCB LED light strip 100. A light-strip board 105 is made of an insulating material, such as fiberglass, phenolic plastic, etc., that has printed conductors or busses 110 thereon. Conductors 110 extend down the length of strip 100, are typically made of copper, and are securely bonded to board 105 in well-known fashion.

The board has a row of LED assemblies, such as assembly 115, each having a central light-emitting portion 120 and at least two electrical connections 125. The LED assemblies are bonded to strip 100 using an adhesive compound (not shown) between the underneath surface of each assembly and board 105 and connections 125 are soldered to conductors 110 (FIG. 1), respectively, using well-known reflow soldering methods. The combination of the adhesive and solder bonds firmly secures the LED assemblies to board 105.

The semiconductor junctions that form the LEDs produce light when energized by a limited, direct-current potential source. Excessive currents or reverse potentials can cause failure of a device. Because of this, LED assemblies contain well-known current limiting circuitry, such as a resistor or current-limiting integrated circuit (not shown). If they are to be operated by an alternating current source, they also contain a rectifier (not shown) to prevent application of a reverse potential to the junction of the device.

The length of LED strip 100 can be short and include from one LED assembly 115 to several, or it can be very long and include many LED assemblies like assembly 115. In some applications a plurality of strips 100 are joined together, end-to-end.

In all applications, it is necessary to apply electrical power to conductors 110 on strip 100 in order to energize the LEDs. In the past, this was done by soldering wires to conductors 110. Wires from a power source (not shown) were soldered to conductors 110 and a plurality of strips 100 were electrically connected at their ends by soldering their respective conductors 110 together. While these connections worked, they were not easily disconnected. In addition, the spacing between assembly 115 at the end of a first strip 100 and a second assembly (not shown) at the beginning of a second strip (not shown) often would be different from the spacings of the remaining LED assemblies on each strip. This difference in spacing would call undesired attention to the joint between the first and second strips.

DESCRIPTION

Figure 8:
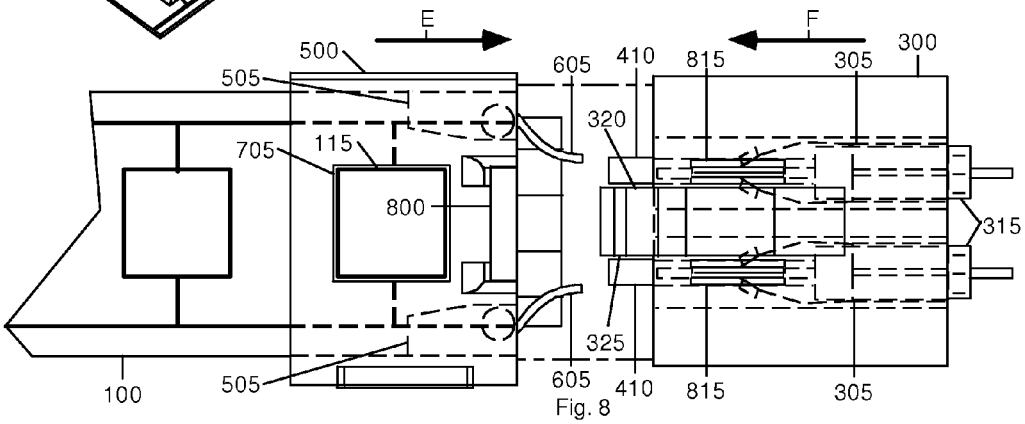
FIG. 8 is a plan view showing two components of a LED connector assembly ready to be joined.

First Aspect of First Embodiment—Wire Connector—FIGS. 3, 4, and 8

FIG. 3 shows an exploded exterior perspective view of a power or wire connector portion or half 300 that can alleviate one or more of the above problems and that is ready for assembly. Wire connector half 300 of FIG. 3, together with a mating LED strip or anchor connector portion or half 500 (FIG. 5), are used to connect power supply wires 315 to strip of LEDs 100 (FIG. 5). I.e., wires 315 are connected to wire connector half 300 and LED strip 100 is connected to strip connector half 500, whereupon connector halves 300 and 500 can be connected together (mated) to connect the wires to the strip. This section discusses wire connector half 300 and its connection to wires 315 and the next section discusses strip connector half 500 and its connection to LED strip 100.

Wire connector half 300 has a housing 310 with a boxlike shape with a hollow interior and open left and right ends. A pair of wire-gripping terminals 305 are shown outside the left end but are assembled by securely molding them into housing 310. Wires 315 comprise a pair of wires with stripped ends; these are inserted into respective terminals 305 as described infra. Housing 310 has a bendable tongue 320 with a raised tip 325 that extends upward from the top surface of housing 310. Tongue 320 can be inserted and removably locked into a recess in LED strip connector half 500, as discussed infra. Connector half 300 is made of an electrically insulating plastic such as nylon, polycarbonate or polypropylene.

FIG. 4 shows one of terminals 305 of connector half 300 with one of wires 315 installed. Each wire 315 comprises an electrical conductor such as copper that is surrounded with an electrically insulating material such as vinyl. Terminal 305 comprises a collar 400, two arms 405, and a contact tongue 410. Installation of wires 315 begins with the removal, or stripping, of insulation from the ends of wires 315 for a distance about equal to one half the length of terminal 305. Wires 315 are then inserted through respective collars 400 until the stripped ends extend past the ends of arms 405 toward the distal end of contact tongue 410. Each of the wires or conductors in wires 315 is of sufficient diameter to springably urge arms 405 apart as each wire 315 is inserted into its terminal 305. Arms 405 pinch the conductor in each of wires 315 and therefore resist the removal of wires 315 by pulling from behind collar 400. Collar 400 is crimped securely against the insulation of wires 315 when added resistance to removal of these wires from terminal 305 is required. Terminal 305 is formed from a single, stamped piece of springable metal such as steel in well-known fashion. Terminal 305 can be either plated with a metal such as chromium or gold, or left as-is. On one realization of the connector the diameter of the group of conductors in each of wires 315 was about 1 mm, although other sizes can be used, depending upon the electrical current requirement of the LED strip. In lieu of a group of conductors, wires 315 can constitute a single conductor.

Arms 405 of terminal 305 further include a pair of curved wings 415 that are used in the removal of wire 315. When it is desired to remove wires 315 from terminal 305 wings 415 are displaced or pried apart by a lever such as the tip of a standard, flat-tipped cabinet screwdriver. A pair of slots 815 (FIG. 8) are provided for this purpose when terminal 305 is installed in connector half 300.

The right side of FIG. 8 shows a plan view of connector half 300 assembled and ready to use. A pair of wires 315 are connected to terminals 305, which are in turn installed in housing 310 of connector half 300.

DESCRIPTION

Second Aspect of First Embodiment—LED Connector and Anchor—FIGS. 5 Through 7 and 8

FIGS. 5 through 7 show one aspect of anchor connector half 500 which is connected to or terminates LED strip 100 to enable strip 100 to be electrically connected to wire connector half 300 and hence wires 315 (FIG. 3).

FIG. 5 is a perspective view of LED connector and anchor half 500 which is used to connect to and hold strip 100. The busses or conductors 110 on strip 100 have solder bumps 510 at the ends of the strip to improve the electrical and mechanical contact to strip connector half 500.

Connector half 500 has a pair of spring clip electrodes 505 that are used to provide electrical contact to tongue 410 of collar 400, as described below. Electrodes 505 each have a channel shape and are mounted on connector half 500 so that the open sides of the channels face each other. Connector half 500 also includes a lid 700 with openings 705 and 710. Lid 700 is secured to body 715 by a "living" hinge 720 of flexible plastic material that is formed together with body 715 in well-known fashion. Alternatively, hinge 720 can be a standard "piano" hinge or other kind of hinge that hingedly joins lid 700 to body 715. Connector half 500 is formed by injection molding or another well-known method. FIG. 5 also shows LED strip 100, described supra.

FIG. 6 is a perspective view of one of spring clip electrodes 505 on connector half 500. Electrodes 505 comprise a channel-shaped body part 600. A curved arm 605 extends from one end of one side of the channel. One or more teeth 615 are provided at the inner, upper side of the channel of electrode 505 in order to provide secure electrical contact to buss 110. Additional teeth 610 are provided on the inner edge of the lower side of the channel to secure electrode 505 to board 110 when the two are joined (FIGS. 5 and 7). Electrodes 505 are formed of the same material as terminals 305. Electrodes 505 are secured within connector half 500 when it is molded.

To assemble strip 100 and connector half 500, strip 100 is slidably engaged into the channels of electrodes 505 as indicated by arrow A. Teeth 615 in electrodes 505 (FIG. 6) engage conductors or busses 110 via solder bumps 510 (if present) and teeth 610 in engage the under-surface of strip 100 to secure strip 100 in electrodes 505.

FIG. 7 is a perspective view showing strip 100 and placed in electrodes 505 of connector half 500, ready for the closing of connector half 500.

When lid 700 is closed (arrow D) opening 705 surrounds LED 115, thereby securing connector half 500 to strip 100. At the same time, a projection 725 on body 715 of connector half 500 slidably engages opening 710, thereby locking lid 700 in a closed position. After it has been locked, lid 700 can be opened by springably urging opening 710 away from projection 725 and raising lid 700. Although strip 100 and connector half 500 are secured together in part by the capture of LED 115, the light output of the first LED 115 on strip 100 is not obscured since LED 115 is fully exposed through opening 705.

The left side or FIG. 8 is a plan view of connector half 500 in a closed and locked condition showing LED 115 of strip 100 held securely in place within opening 705. The top of connector half 500 has a female socket 800 that receives and holds a spring catch or tongue 320 of connector half 300. The right side of FIG. 8 shows connector half 300, ready to be mated with connector half 500 as indicated by arrows E and F. Arms 605 of electrodes 505 are prepared to slidably contact tongues 410 of terminals 305.

Figure 9:
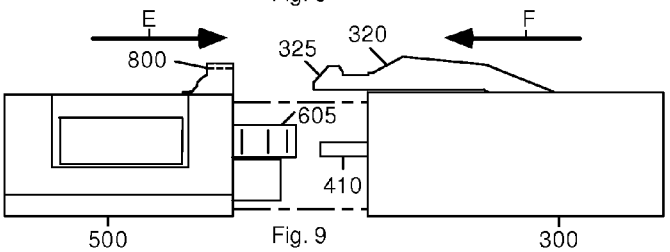
FIG. 9 is a side view of the components in FIG. 8.

FIG. 9 is a simplified side view of connector halves 300 and 500 prior to the joining of the two parts. Connector half 500 includes female socket 800 (FIGS. 8 and 9). Connector half 300 includes a tongue portion 320 with a tip portion 325 (FIGS. 8 and 9) that is sized to slidably enter socket 800 when connector halves 300 and 500 are urged together from the positions shown in FIGS. 8 and 9. Tongue 320 springably urges tip 325 upward so that when tip 325 enters socket 800 tip 325 will remain secured in socket 800 until tongue 320 is manually depressed. As also shown in FIG. 8, arms 605 of electrodes 505 are prepared to slidably contact tongues 410 of terminals 305.

OPERATION

Figure 10:
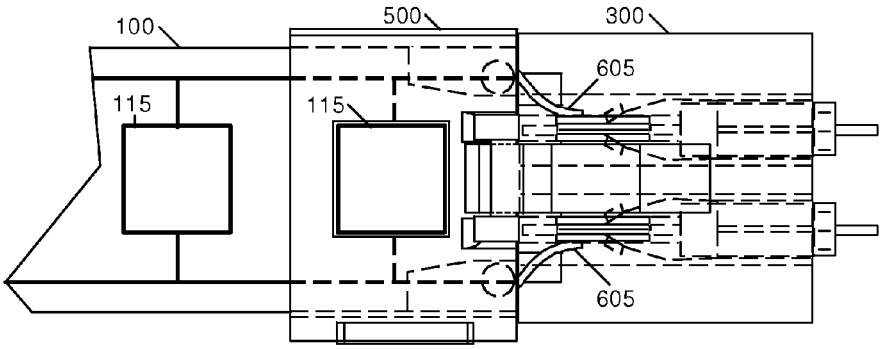
FIG. 10 is a plan view showing the two components of FIGS. 8 and 9 after they are connected.

First and Second Aspects of a First Embodiment are Joined—FIG. 10

FIG. 10 is a plan view showing the previously prepared connector halves 300 and 500 and their related components. Connector halves 300 and 500 have been urged together, as indicated by arrows E and F (FIGS. 8 and 9). Tip 325 of tongue 320 has springably and slidably entered socket 800 and is secured there by the upward spring force exerted by tongue 320, thereby securing the two housings together.

Arms 605 of electrodes 505 are springably urged against contact tongues 410 of terminals 305, making secure electrical contact between electrodes 505 and terminals 305. All components are now securely attached to one-another. LEDs 115 on strip 100 are ready for use and no portion of the light output of strip 100 is obscured by connector half 500.

DESCRIPTION AND OPERATION

Figure 11:
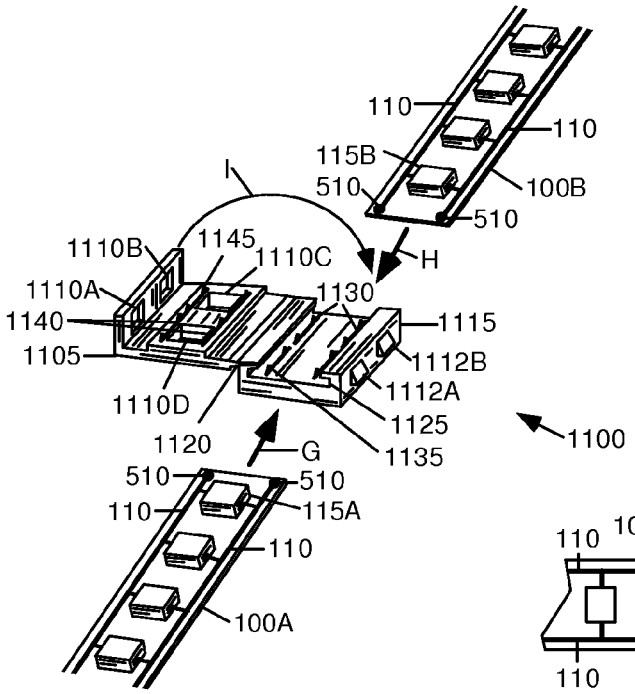
FIG. 11 is a perspective view of an alternate embodiment, ready for assembly.
Figure 12:
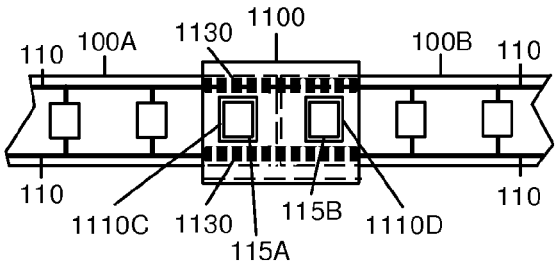
FIG. 12 is a plan view of the embodiment of FIG. 11 after assembly.

Second Embodiment—FIGS. 11 and 12

FIG. 11 shows a perspective view of a second embodiment, here a connector for connecting two strips together. Specifically a connector 1100 is arranged to join and transferring power between two strips of LEDs 100A and 100B. Connector 1100 is constructed similarly to connector half 500. Connector 1100 comprises a lid 1105 and a body 1115 that are joined by a living hinge 1120 or a piano hinge or other similar arrangement. Lid 1105 includes a plurality of openings 1110A, 1110B, 1110C, and 1110D.

Openings 1110A and 1110B removably mate with projections 1112A and 1112B when lid 1105 is closed, as indicated by arrow I.

Body 1115 further includes an open channel 1125. Channel 1125 further includes a plurality of gripping members 1130 on its lower surface. Members 1130 include a plurality of teeth 1135 and are made of metal or plastic. Strips 100A and 100B are installed in body 1115 by slidably urging them into channel 1125 as shown by arrows G and H, respectively. Teeth 1135 engage the lower side of strips 100A and 100B as the strips are urged into channel 1125. When they are fully inserted, strips 100A and 100B meet near the middle of body 1115 and LEDs 115A and 115B are located adjacent openings 1110D and 1110C, respectively.

Lid 1105 further includes a pair of electrodes 1140 with a plurality of teeth 1145. Electrodes 1140 are positioned so that when strips 100A and 100B have been installed and lid 1105 is closed, teeth 1145 will securely engage and connect solder bumps 510 and busses 110 on strips 100A and 100B.

FIG. 12 is a plan view showing strips 100A and 100B properly installed in connector 1100. Openings 1110A and 1110B have springably and removably engaged projections 1112A and 1112B (FIG. 11), respectively so that connector 1100 is securely closed. Conductive members 1130 and teeth 1135 have been firmly urged against and connected busses 110, and LEDs 115A and 115B are secured within openings 1110C and 1110D, respectively.

Connector 1100 is molded and made of the same material as connector halves 300 and 500, although other materials can be used. Members 1130 and electrodes 1140 are made of a sturdy, electrically conductive metal such as steel, copper, brass, or another material, although members 1130 can be made of another, electrically non-conductive material. They are installed in connector 1100 either at the time of molding, or they can be installed at a later time.

Conclusions, Ramifications, and Scope

The present method and apparatus securely electrically and mechanically connects a LED strip to a power source connector and also permits the secure electrical and mechanical joining of two LED strips without the need for soldering. In various aspects it has one or more of the following advantages: the ability to make and release connections faster, the provision of a low-profile, flat connector for a PCB, and the provision of a compact connector.

While the above description contains many specificities, these should not be construed as limitations on the scope, but as exemplifications of some present embodiments. Many other ramifications and variations are possible using the system and methods described. For example, round LEDs can be used instead of square, with round openings in the lids of the LED holders. Mounting holes can be included in the bases of the LED holders so that fasteners can be used to secure the connectors to a surface. Adhesive can be applied to the underneath surface of the LED holders so that they can be secured to a surface. Different widths and sizes of LEDs and different wire gauges and conductor widths and thicknesses can be used. The holders can be supplied in any color. Instead of a hinge joining the cover and the base, a snap-on cover or two-piece can be provided.

Thus the scope should be determined by the appended claims and their legal equivalents, rather than the examples and particulars given.

The invention claimed is:

1. An anchoring or strip connector for a light strip containing a plurality of light-emitting diodes and a plurality of strip conductors electrically connected to said light-emitting diodes, comprising:

a base portion, a closable lid attached to said base portion by a hinge, said lid including at least one opening for admitting a light-emitting diode when said lid is closed, a plurality of electrodes in said lid arranged to contact said respective plurality of strip conductors on said strip when said strip is positioned on said base portion and said lid is closed, said plurality of electrodes also arranged to be connected to a plurality of power-supply terminals, whereby when said strip is positioned on said base portion and said lid is closed, at least one light-emitting diode on said strip is admitted into said opening and said plurality of electrodes are urged into contact with said plurality of conductors so that said light-emitting diode can receive power from said power-supply terminals via said strip conductors when said power-supply terminals are energized.

2. The anchoring connector of claim 1, further including a wire connector portion containing a pair of power supply terminals arranged to be connected to a pair of conductors wire for energizing said terminals, said wire connector portion arranged to slidably mate with said anchoring connector and thereby urge said terminals on said wire connector portion on into contact with said electrodes in said anchoring connector, thereby connecting said strip with said wires.

3. The anchoring connector of claim 2 wherein said terminal includes at least one wing for prying said terminal open in order to release said wire, and said wire connector portion includes at least one slot adjacent said wing so that a flat-tipped instrument can be inserted into said slot to displace said wing and release said wire from said terminal.

4. The anchoring connector of claim 2, further including an opening in said lid and a mating projection on said base, said opening and said projection being positioned so that said projection in inserted into said opening when said lid is closed, thereby securing said anchoring connector in a closed condition.

5. The anchoring connector of claim 1 wherein said conductors on said strip each have a terminus including a solder bump for positively engaging said electrodes in said lid when said lid is closed.

6. An anchoring connector for joining first and second light strips of the type having a top side, a bottom side, and two ends, each light strip containing a plurality of light-emitting diodes and a plurality of conductors electrically connected to said light-emitting diodes on said top side, each strip having one of said light-emitting diodes at an end of said strip, comprising:

a base portion, a channel in said base portion, said channel extending across said base portion and having first and second ends, a plurality of gripping members secured in said channel of said base portion for gripping said bottom sides of said first and said second light strips when they are inserted into opposite ends of said channel, a closable lid attached to said base portion by a hinge, said lid including first and second openings for admitting said light-emitting diodes at said ends of said first and said second light strips, a plurality of electrodes in said lid arranged to contact said plurality of conductors on said top sides of said first and said second light strips, thereby connecting said plurality of conductors of said first and second strips when said lid is closed, whereby when said first light strip is inserted into said channel from said first end of said channel and said second light strip is inserted into said channel from said second end of said channel and said first and said second light strips abut one-another at the center of said channel and said lid is closed, said gripping members grip said bottom sides of said light strips, said light-emitting diodes at said ends of said first and said second light strips are admitted into said first and said second openings in said lid and said plurality of electrodes in said are urged into contact with said plurality of conductors so that said light-emitting diodes on said second light strip can receive current from said conductors on said first strip when said first strip is energized.

7. The anchoring connector of claim 6 wherein said lid includes at least a third opening and said base includes at least one projection, said third opening in said lid being arranged to mate with said projection on said base when said lid is closed, thereby securing said anchoring connector in a closed condition.

8. The anchoring connector of claim 6 wherein said gripping members are made of materials selected from the group consisting of metal and plastic.

9. The anchoring connector of claim 6 wherein each of said plurality of conductors further includes a solder bump at said ends of said strips so that said electrodes in said lid each connect said plurality of said conductors of said first and second strips via contact with said solder bumps when said lid is closed, thereby improving electrical conduction between said conductors on said first and second strips.

10. An anchoring connector for a light strip having a light-emitting diode at an end, comprising:

an anchor portion and a wire portion, said anchor portion having a base and a closable lid secured to said base by a hinge, said lid having at least one opening for admitting said light-emitting diode, said strip having at least one electrode having a curved arm that is slidably affixed to a conductor on said strip at said end and extending outward therefrom, said wire connector portion containing at least one terminal arranged to receive a wire for energizing said terminal, said wire portion being arranged to slidably mate with said anchor portion and thereby urge said terminal on said wire portion into contact with said electrode on said anchor portion, thereby connecting said strip with said wire.

11. The anchoring connector of claim 10 wherein said conductor on said strip further includes a solder bump interposed between said electrode and said conductor so that said electrode is securely connected to said conductor.

12. The anchoring connector of claim 10, further including at least one additional opening in said lid and at least one projection on said base, said additional opening in said lid being arranged to mate with said projection on said base when said lid is closed, thereby securing said anchoring connector in a closed condition.

13. The connector of claim 10 wherein said wire connector and said anchoring connector are made from materials selected from the group consisting of nylon, polycarbonate, and polypropylene.

14. The connector of claim 10 wherein said terminal includes means for springably gripping said wire, thereby securing said wire in said terminal.

15. The connector of claim 14 wherein said terminal further includes a plurality of wings which can be springably urged apart to enable removal of said wire from said terminal.

16. The connector of claim 14 wherein said wire connector portion further includes an opening adjacent said wings for admitting a lever to urge said wings apart so that said wire can be removed from said terminal.

17. The connector of claim 10 wherein said terminal further includes a collar through which said wire is inserted, said collar being capable of being crimped against said wire so that said wire is securely held within said terminal.

* * * * *